US006519847B1

(12) United States Patent
Trudeau et al.

(10) Patent No.: US 6,519,847 B1
(45) Date of Patent: Feb. 18, 2003

(54) SURFACE TREATMENT OF PREFINISHED VALVE SEAT INSERTS

(75) Inventors: Todd A. Trudeau, Menominee, MI (US); Daniel W. Bancroft, Menominee, MI (US); Cong Yue Qiao, Menominee, MI (US); Douglas W. Dooley, Menominee, MI (US)

(73) Assignee: L. E. Jones Company, Menominee, MI (US)

( * ) Notice: Subject to any disclaimer, the term of this patent is extended or adjusted under 35 U.S.C. 154(b) by 0 days.

(21) Appl. No.: 09/719,431

(22) PCT Filed: Jun. 10, 1999

(86) PCT No.: PCT/US99/13127

§ 371 (c)(1),
(2), (4) Date: Jan. 16, 2002

(87) PCT Pub. No.: WO99/64202

PCT Pub. Date: Dec. 16, 1999

Related U.S. Application Data

(60) Provisional application No. 60/089,085, filed on Jun. 12, 1998.

(51) Int. Cl.[7] ..... B23P 15/00

(52) U.S. Cl. ..... 29/888.44; 29/888.46; 123/188.2; 123/188.3

(58) Field of Search ..... 29/888.44, 888.4, 29/888.46; 148/240, 278, 559; 123/188.2, 188.3

(56) References Cited

U.S. PATENT DOCUMENTS

| | | | | |
|---|---|---|---|---|
| 2,136,690 A | | 11/1938 | Jardine | |
| 2,486,654 A | | 11/1949 | Junkin | |
| 2,898,639 A | | 1/1959 | Gonser, Jr. | |
| 3,318,694 A | | 5/1967 | Heitman | |
| 4,093,453 A | | 6/1978 | Makino et al. | |
| 4,093,454 A | | 6/1978 | Saito et al. | |
| 4,336,432 A | * | 6/1982 | Bajorek | 148/526 |
| 4,378,332 A | * | 3/1983 | Chang et al. | 148/414 |

(List continued on next page.)

FOREIGN PATENT DOCUMENTS

| | | | |
|---|---|---|---|
| EP | 796927 | A | 9/1997 |
| JP | 55100949 | A | 8/1980 |
| JP | 55104451 | A | 8/1980 |
| JP | 55148741 | A | 11/1980 |
| JP | 56055545 | A | 5/1981 |
| JP | 57029550 | A | 2/1982 |
| JP | 57101635 | A | 6/1982 |
| JP | 59074266 | A | 4/1984 |
| JP | 62033089 | A | 2/1987 |
| JP | 08291376 | A | 11/1996 |

OTHER PUBLICATIONS

ASM Handbook, 1992, vol. 3, pp. 2–197 and 3–48.
Easterday James R. P.E., Salt Bath Ferritic Nitrocarburizing, Technology Update, pp. 1–4.

*Primary Examiner*—I Cuda-Rosenbaum
(74) *Attorney, Agent, or Firm*—Burns, Doane, Swecker & Mathis, LLP

(57) ABSTRACT

A method of manufacturing surface treated, prefinished valve seat inserts. The method entails forming the valve seat insert, precision machining the valve seat insert to precise tolerances so that the valve seat insert can be installed in one of the cylinder head and engine block without the need for additional seat machining and treating the valve seat insert with a wear resistant treatment prior to inserting the valve seat insert into on of the cylinder head and engine block.

12 Claims, 1 Drawing Sheet

U.S. PATENT DOCUMENTS 4,400,211 A 8/1983 Kudo et al.
4,400,349 A 8/1983 Kudo et al.
4,421,571 A 12/1983 Kudo et al.
4,438,310 A * 3/1984 Cachat ..... 148/526
4,556,607 A 12/1985 Sastri
4,643,781 A * 2/1987 Vickers et al. ..... 123/188.8
4,791,259 A * 12/1988 Pfaffmann ..... 123/188.8
4,999,911 A 3/1991 Anderson
5,040,501 A 8/1991 Lemelson
5,060,374 A * 10/1991 Findlanl et al. ..... 29/888.44
5,084,113 A * 1/1992 Mori et al. ..... 123/188.3
5,188,659 A * 2/1993 Purnell ..... 148/334
5,314,659 A 5/1994 Hidaka et al.
5,424,029 A 6/1995 Kennedy et al.
5,662,745 A * 9/1997 Takayama et al. ..... 123/188.3
5,674,449 A 10/1997 Liang et al.
5,745,993 A 5/1998 Adachi et al.
5,802,716 A * 9/1998 Nishimura et al. ..... 29/888.06
5,808,214 A 9/1998 Kaneko et al.
5,934,238 A 8/1999 Wang et al.
5,970,614 A * 10/1999 Adachi et al. ..... 29/888.061
6,096,142 A * 8/2000 Kano et al. ..... 148/435
6,200,688 B1 * 3/2001 Liang et al. ..... 123/188.3
2002/0050307 A1 * 5/2002 Nakamura et al. ..... 148/218

* cited by examiner

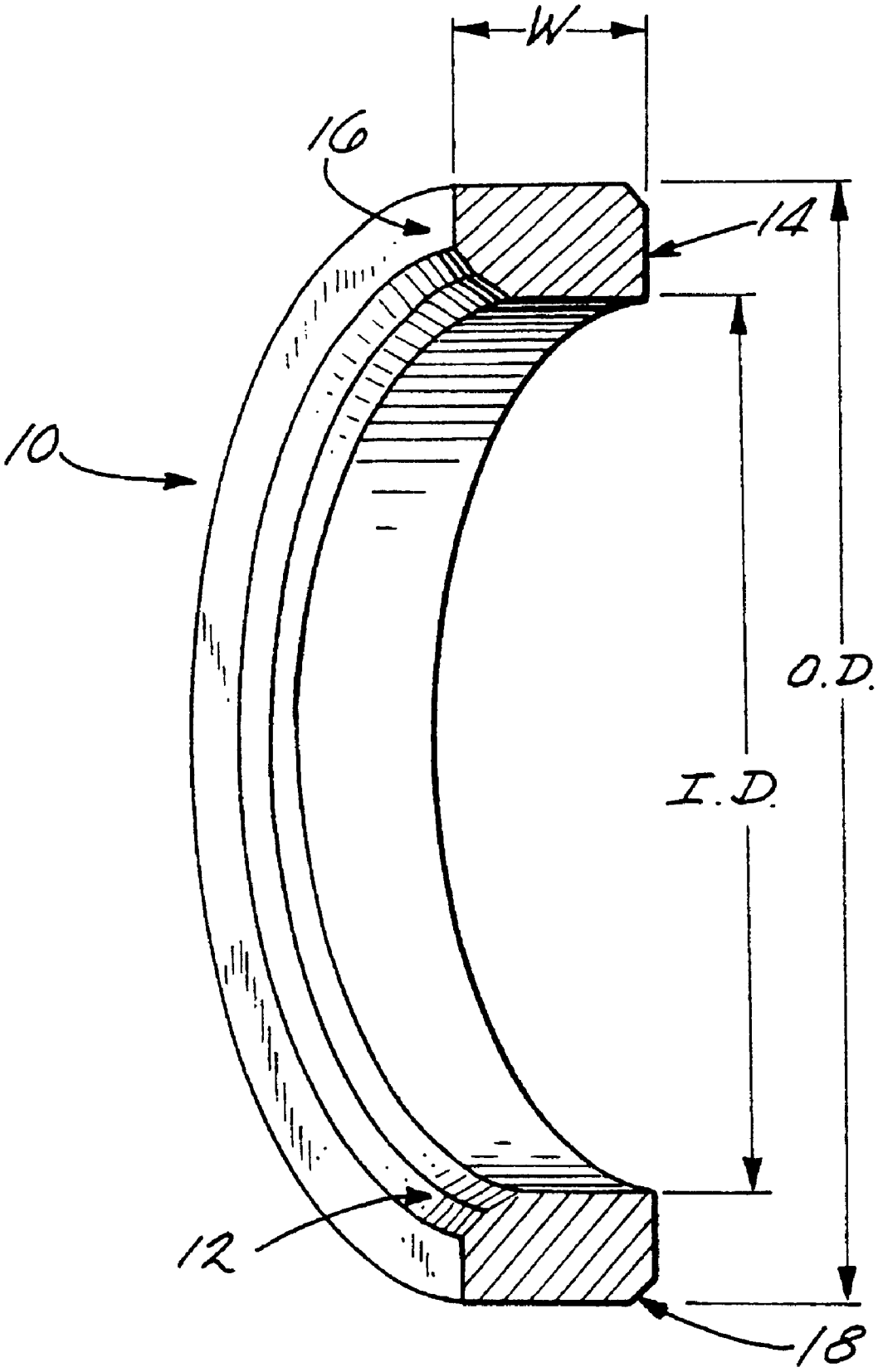
W
16
14
10
O.D.
I.D.
12
18

SURFACE TREATMENT OF PREFINISHED VALVE SEAT INSERTS

This application claims benefit of Ser. No. 60/089,085 Jun. 12, 1998.

BACKGROUND OF THE INVENTION

1. Technical Field

The present invention relates to valve seat inserts for internal combustion engines and methods of making the same, and more specifically, to valve seat inserts that are precision formed and surface treated prior to insertion into internal combustion engines.

2. Related Prior Art

Valve seat inserts produced by known monolithic or composite methods may suffer wear in certain engine applications or they may cause wear of other engine parts such as the mating valve. In using monolithic or composite valve seat inserts, it is necessary to finish machine the seating surface after insertion into the cylinder head or engine block. In order to do this finish machining, the material employed in the insert must have some amount of machinability, which, in turn, may compromise the material's wear resistance.

When using monolithic material, it is normal practice to produce valve seat inserts out of the monolithic material via casting, wrought, or powder metallurgy practices. The valve seat inserts are then inserted into the cylinder head or engine block, and the seating surface is machined. The wear resistance of the insert's seating surface is thus the same as the bulk monolith from which the insert has been made, and is generally susceptible to wear problems.

Composite type inserts have also been used, with either a weld overlay or a bimetallic power metallurgy product, with a wear resistant material applied over a lower alloy substrate. However, the valve seat is first inserted into the cylinder head or engine block, and the seating surface is then finish machined after insertion. This finish machining after the wear resistant material has been applied compromises the resistant material, and makes the valve seat insert more susceptible to wear.

SUMMARY OF THE INVENTION

The present invention is a substantial modification over existing processes used to produce valve seat inserts. The invention overcomes the above limitations of the prior art by precision forming the valve seat insert and then performing a wear resistant or surface hardening treatment upon the valve seat insert prior to inserting the insert into the engine block. The invention also allows for the use of coating/surface treatments having very thin layers that would be completely removed if any machining were subsequently done after treatment. In a preferred embodiment, the coating/surface treatment typically produces less than 0.05 mm dimensional change on the surface of the insert.

Specifically, the valve seat insert is formed, and the seating surface of the valve seat insert is precision machined. The precision formed seating surface of the valve seat insert is then hardened using a hardening technique. In some embodiments, the hardening step occurs by applying a wear resistant coating or surface treatment to the precision seating surface. The coating or treatment chosen is such that minimal dimensional changes are produced in the precision seating surface. Finally, the precision formed and hardened valve seat insert is inserted into the cylinder head or block of the engine without the need for additional machining.

Before embodiments of the invention are explained in detail, it is to be understood that the invention is not limited in its application to the details of the articles, composition or concentration of components, or to the steps or acts set forth in the following description. The invention is capable of other embodiments and of being practiced or being carried out in various ways. Also, it is understood that the phraseology and terminology used herein is for the purpose of description and should not be regarded as limiting.

BRIEF DESCRIPTION OF THE DRAWING

The FIGURE shows a cross-sectional view of a valve seat insert of one embodiment of the invention.

DETAILED DESCRIPTION

Generally, the valve seat inserts, and process for producing the valve seat inserts according to the invention can be broken down into two general aspects: first, the valve seat inserts are precision formed, and second, the precision formed valve seat inserts are treated to increase wearability prior to insertion into the engine block.

In one embodiment, valve seat inserts are formed by sand casting a modified molybdenum high speed steel commercially available from L. E. Jones under the designation alloy J120V to form the valve seat inserts. Sand casting techniques generally known in the art are used. It should be understood, however, that the use of other techniques for producing rough valve seat inserts are contemplated. Additionally, the use of different alloys or materials is contemplated for use in the current invention, and that the invention is not limited to these specifics.

Next, the valve seat inserts were precision machined to produce a seating surface with the following tolerances:

| | |
|---|---|
| Seat Angle | +/−0.25 Degrees |
| Surface Finish | 50 Microinch (1.3 $\mu$m.) AA Maximum |
| Seat-OD Runout | 0.001 Inch (.025 mm.) Maximum |

Referring to the FIGURE, precision machining procedures are utilized to produce an insert 10 with a seating surface where the seat 12 angle, the seat 12 surface finish, the seat 12 profile, and the seat runout as compared to both the outside diameter (O.D.) and the bottom face 14 of the valve seat insert 10 are all controlled to very precise tolerances. These controls produce prefinished valve seat inserts, which can be installed in cylinder heads or engine blocks with no need for additional seat machining. It should be understood that known machining processes that can produce such exact tolerances are usable in the current invention.

In one embodiment, the following machining process is used. After casting the rough valve seat insert, the gate remnant from the casting process is first ground off. Next, a double disk grinder is used to rough grind the top face 16 and bottom face 14 of the insert 10 close to finish size. Multiple grinding passes may be used depending on insert size and material. Then, the outside diameter (O.D.) of the insert 10 is ground on the outside diameter via centerless grinding until it is close to the finish size. A lathe is next utilized to bore the inside diameter (I.D.), if required, and to turn a lead chamfer 18 on the outside diameter (O.D.). A finish double disk grinder operation now grinds the faces 14, 16 to the finish width (W) followed by a finish centerless grind to the finish outside diameter (O.D.). Parts are then vibratory finished to both clean and deburr them. The final machining operation is precision machining of the seating surface. Turning is a common method of doing this and it is necessary to control seat angle, seat 12 to O.D. runout, and seat surface finish to the previously mentioned tolerances. Another potential manufacturing method would be to grind the precision seat.

After the valve seat insert 10 is precision formed, it is treated to increase the wear resistance of the insert. Most known wear resistant treatments generally known in the art may be used in the current invention. However, the wear resistance treatment should preferably produce a minimum amount of dimensional distortion to the precision formed valve seat insert. In preferred embodiments, the wear resistance treatment typically produces less than 0.05 mm dimensional change on the surface of the insert.

The wear resistance treatment preferably includes any one of the following processes: ferritic nitrocarburizing, carbonitriding and physical vapor deposition. Physical vapor deposition provides one method of depositing coatings such as nitride and carbide coatings. The prefinished valve seat insert may be coated with a nitride coating, such as titanium nitride, chromium nitride, or titanium aluminum nitride. Alternatively, the prefinished insert may be coated with a carbide coating such as a chromium carbide. It should be understood that the above examples do not comprise an all-inclusive list and do not in any way limit the employment of other wear resistant coatings or surface treatments in the current invention.

In one embodiment, ferritic nitrocarburizing is used as the wear resistant treatment. The inserts were ferritic nitrocarburized in a molten salt bath to produce a hardened surface layer with a 750 HK minimum Knoop hardness at a depth of 0.0021 inches or 0.05 mm. A ferric nitrocarburizing process known and developed by Kolene Corporation is preferably used.

Ferritic nitrocarburizing is a thermochemical diffusion process whereby nitrogen and carbon are simultaneously introduced into the surface of ferrous metals to develop or enhance particular engineering properties and thus increase performance. The process is carried out at a subcritical treatment temperature, typically 1075° F. (580° C.), in a molten salt bath composed of a mixture of cyanates and carbonates of sodium and potassium. This proprietary salt bath is known commercially as Kolene Nu-Tride® and conforms to AMS 2753.

Salt bath nitrocarburizing improves wear resistance, lubricity, fatigue strength, and corrosion resistance as a result of the presence of an iron nitride compound(s) formed at the surface, in addition to a zone of diffused nitrogen in solid solution with the base material, subjacent to the compound layer. Both of these zones are metallurgically discernible, each providing specific engineering properties.

Surface treatment at subcritical temperatures, using a bath of molten salt as the source of nitrogen and carbon, has been known historically as "liquid nitriding" or "salt bath nitriding". Although both terms are still used today, this process now falls under the generic classification "ferritic nitrocarburizing", and is more precisely identified as "salt bath nitrocarburizing (SBN™)" by Kolene Corporation.

The salt bath nitrocarburizing process used begins with a prewash and preheat cycle, 750° F. (400° C.), to ensure that the valve seat inserts are clean and dry. Also, a load of components that have been uniformly preheated, will reduce thermal shock and permit more efficient recovery of the salt bath nitrocarburizing bath temperature.

The load is then transferred to a bath a Nu-Tride® bath, which is proprietary to Kolene, and held a predetermined period of dwell time, dependent on the required depth of compound layer. From the Nu-Tride® bath, the valve seat inserts are quenched into an oxidizing salt bath made up of a KQ-500® bath, which is commercially available from Kolene, at a lower temperature, typically 750° F. (400° C.), and held from 5 to 20 minutes.

After the oxidizing quench, the valve seat inserts are cooled to room temperature, rinsed, and if required, subjected to post treatment. This may include mechanical polishing if surface finish is of concern, or other treatment to develop maximum corrosion protection and/or enhance the cosmetic appearance.

Example 1: Prefinished valve seat inserts made from L. E. Jones Co. alloy J120V were ferritic nitrocarburized. During the ferritic nitrocarburizing process, the Nu-Tride® bath temperature was 1075° F. (580° C.) and the process time was 90 minutes. The Knoop Hardness (HK) of the resulting inserts is as follows:

| Depth Below Surface (mm) | Knoop Hardness (HK) |
|---|---|
| 0.02 | 882 |
| 0.04 | 876 |
| 0.05 | 821 |
| 0.06 | 760 |
| 0.08 | 613 |
| 0.10 | 563 |
| 0.15 | 549 |
| 0.20 | 539 |

Valve seat inserts from Example 1 were subsequently tested in a six cylinder turbocharged diesel engine. The engine was equipped with a split set-up of Example 1 inserts and L. E. Jones Co. J589 alloy inserts with each material being run in three cylinders. J589 is a premium iron-based valve seat insert material which is known for its very high hardness and excellent wear resistance. Each cylinder contains two inserts of the materials being tested (6 inserts total of each material). The engine was run for 500 hours under rigorous test conditions. After test, total wear for the valve and insert were measured. Wear results were as follows:

| Insert Alloy | Total Wear (inches) |
|---|---|
| J589 | 0.001" or less (for all six inserts tested) |
| Iron Based alloy of Example 1 | 0.001" or less (for all six inserts tested) |

While some embodiments of the invention have been discussed above, alternate embodiments will be apparent to those skilled in the art and are within the intended scope of the present invention.

What is claimed is:

1. A process for forming a prehardened valve seat insert for insertion into a cylinder head or an engine block of an internal combustion engine, said process comprising the steps of:

forming the valve seat insert;

precision machining the valve seat insert to precise tolerances so that the valve seat insert can be installed in one of the cylinder head and the engine block without the need for additional seat machining; and treating the valve seat insert with a wear resistant treatment prior to inserting the valve seat insert into one of the cylinder head and the engine block, wherein the treating step includes ferritic nitrocarburizing, carbonitriding, or a physical vapor deposition process.

2. The process of claim 1 wherein the treating step includes ferritic nitrocarburizing the valve seat insert.

3. The process of claim 1 wherein the treating step includes carbonitriding the valve seat insert.

4. The process of claim 1 wherein said treating step includes treating the valve seat with a wear resistant surface treatment.

5. The process of claim 1 wherein said wear resistant treatment produces less than 0.05 mm of dimensional change on the surface of the valve seat insert.

6. The process of claim 1 wherein the treating step includes using a physical vapor deposition process to apply a wear resistant surface treatment to the valve seat insert.

7. The process of claim 1 wherein the wear resistant treatment includes a titanium nitride coating.

8. The process of claim 1 wherein the wear resistant treatment includes a chromium nitride coating.

9. The process of claim 1 wherein the wear resistant treatment includes a chromium carbide coating.

10. The process of claim 1 wherein the wear resistant treatment includes a titanium aluminum nitride coating.

11. A valve seat insert prepared by a process comprising the steps of:

forming the valve seat insert;

precision machining the valve seat insert to such precise tolerances so that the valve seat insert can be installed in one of the cylinder head and the engine block without the need for additional seat machining; and treating the valve seat insert with a wear resistant treatment prior to inserting the valve seat insert into one of the cylinder head and the engine block, wherein the treating step includes ferritic nitrocarburizing, carbonitriding, or a physical vapor deposition process.

12. The valve seat insert of claim 11 wherein the treating step includes ferritic nitrocarburizing.

* * * * *